US006935920B1

(12) United States Patent
Wa

(10) Patent No.: US 6,935,920 B1
(45) Date of Patent: Aug. 30, 2005

(54) TOY TRAIN ACCESSORY

(75) Inventor: Choi Man Wa, Hong Kong (CN)

(73) Assignee: Battat Incorporated, Plattsburgh, NY (US)

( * ) Notice: Subject to any disclaimer, the term of this patent is extended or adjusted under 35 U.S.C. 154(b) by 0 days.

(21) Appl. No.: 10/236,405

(22) Filed: Sep. 6, 2002

(51) Int. Cl.[7] ..... A63H 18/00

(52) U.S. Cl. ..... 446/444; 446/96; 446/409; 446/477; 238/10 F

(58) Field of Search ..... 446/96, 409, 410, 446/431, 435, 441, 444, 446, 465, 467, 470, 471, 477, 358; 463/61, 62, 58; 238/10 A, 10 B, 10 C, 10 E, 10 F; 104/295, 296, 303

(56) References Cited

U.S. PATENT DOCUMENTS 2,961,797 A * 11/1960 Bonanno ..... 446/288
3,562,950 A * 2/1971 Genin ..... 446/236
3,688,436 A * 9/1972 Kazuo ..... 104/307
3,729,866 A * 5/1973 Faller et al. ..... 446/442
4,004,765 A * 1/1977 Barlow ..... 246/118
4,493,669 A * 1/1985 Neuhierl ..... 446/103
5,342,048 A * 8/1994 Jones et al. ..... 463/62
5,590,855 A * 1/1997 Kato et al. ..... 246/202
5,967,052 A * 10/1999 Prokopf ..... 104/126
6,059,237 A * 5/2000 Choi ..... 246/192 A

* cited by examiner

*Primary Examiner*—Bena Miller
(74) *Attorney, Agent, or Firm*—Levisohn, Berger & Langsam LLP

(57) ABSTRACT

A toy train accessory for use with a toy train is provided and has at least one track section disposed across the accessory and connectable to a toy train track. A slot is formed in the track section, and an upwardly spring biased sensor is disposed in the slot. At least one entertainment device such as a light or sound generator is connectable to the sensor. When a toy train passes over the sensor on the track, the entertainment device is activated.

20 Claims, 6 Drawing Sheets

TOY TRAIN ACCESSORY

BACKGROUND OF THE INVENTION

1. Field of the Invention

The invention relates to toy trains, and more specifically to accessories for use with toy trains and their respective tracks.

2. Description of the Related Art

Children and adults like to play with toy train sets. A track may be assembled in a variety of configurations, a train is placed on the track, and the user watches it travel around the track. Typically, the track is a closed loop so that the train may repeat a course over and over again. More advanced train systems may have track switching mechanisms which may manually or automatically switch a train from one portion of the track to another.

However, simply watching a train travel around a track may not be sufficiently interesting for some individuals. It is desired to be able to add to the fun and excitement of playing with toy trains.

It is known to provide accessories for toy train tracks for the train to pass through or by, such as a bridge, a tunnel, or a train station. Several prior U.S. patents discuss toy train stations to be used with toy trains and toy train tracks, such as U.S. Pat. Nos. 2,639,548 to Hall; 2,933,854 to Crosman; 5,169,355 to Tammera; and 6,059,237 to Choi (not the present inventor), the teachings of all of which are incorporated by reference herein. None of these prior devices teaches or suggests a simple, inexpensive to manufacture, easy to use, and safe device for use with a toy train set. For example, Hall describes a device where a section of track is insulated so that a train passing thereby will stop or slow down for a period of time. However, to re-energize the train, a circuit must be completed through the wheels and other external metallic parts of the locomotive. Deleterious results may occur if a child were to touch the locomotive while it was part of the electrical circuit. Also, Tammera teaches a toy train station in which passengers "board" a train; in reality, they are rotated upwards into the roof of the station, thereby making it seem as if they boarded the train. However, the mechanism for causing the passengers to be rotating the passengers out of view is activated manually by the person playing with the train set; there is no teaching of an automatic aspect of this device. Similarly, Choi teaches the use of a modified train designed to interact with sensors disposable on a track. This device is too complicated for young children to use, since they must carefully place the sensors on the track in a manner that the sensor will detect the train but not interfere with the train's travel.

SUMMARY OF THE INVENTION

Accordingly, it is an object of the invention to provide a device for augmenting the amount of fun one may obtain from playing with a toy train set.

It is another object of the invention to provide a device for augmenting the amount of fun one may obtain from playing with a toy train set that does so easily and safely.

It is another object of the invention to provide an automatic toy train accessory such as a station or a bridge for use with a toy train set that is simple, inexpensive to manufacture, easy to use, and safe for children.

The above and other objects are fulfilled by the invention, which is a toy train accessory for use with a toy train. It is provided with at least one track section which is connectable to a toy train track. A slot is formed through the track section, and a sensor is disposed in the slot. At least one entertainment device is connected to the sensor. When a toy train passes over the sensor on the track, the entertainment device is activated. The entertainment device may be a light, a sound generator, a lifting bridge, or other such entertainment device. The sound generator may preferably play prerecorded sounds when activated. In one embodiment, the sound generator will select a different of the prerecorded sounds each time the sound generator is activated.

The invention may also include a circuit board connected between the sensor and the entertainment device for controlling the activity of the entertainment device. For example, the sound generator plays prerecorded sounds when activated by the circuit board and may preferably select a different of the prerecorded sounds each time the sound generator is activated by the circuit board.

Any type of known sensor is contemplated, for example, a leaf spring, a photosensor, a magnetic sensor, or the like. Multiple entertainment devices can be simultaneously activated. For example, one track-mounted sensor may control the light and speaker of a toy train station. In another embodiment, the sensor can lower a bridge when a train approaches and lift the bridge when the train has passed over.

DETAILED DESCRIPTION OF THE PREFERRED EMBODIMENTS AND DRAWINGS

Description will now be given of the invention with reference to FIGS. 1–5. It should be noted that these drawings are exemplary in nature and in no way serve to limit the scope of the invention, which is defined by the claims appearing hereinbelow.

Figure 1:
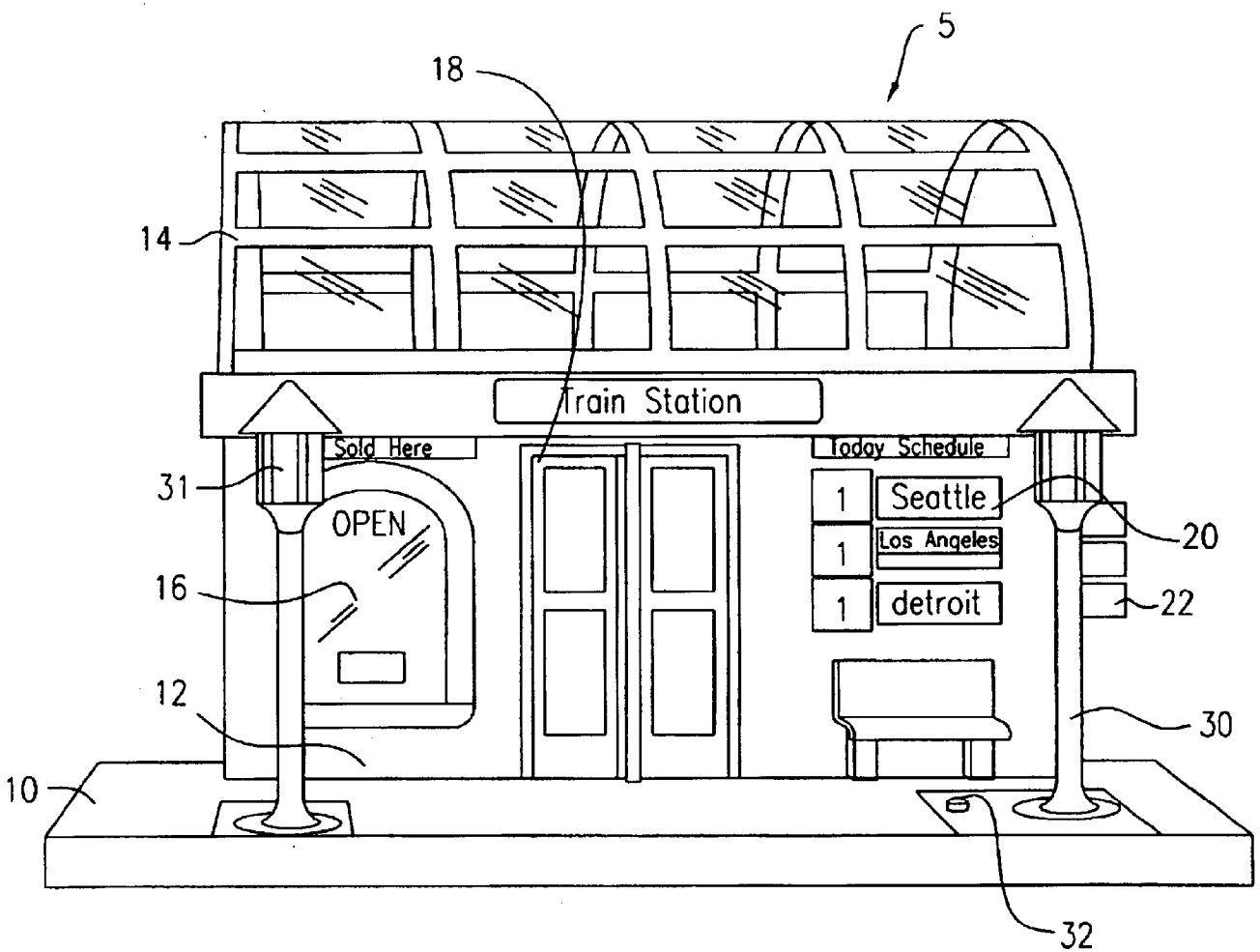
FIG. 1 is a front plan view of a toy train station according to the invention.
Figure 2:
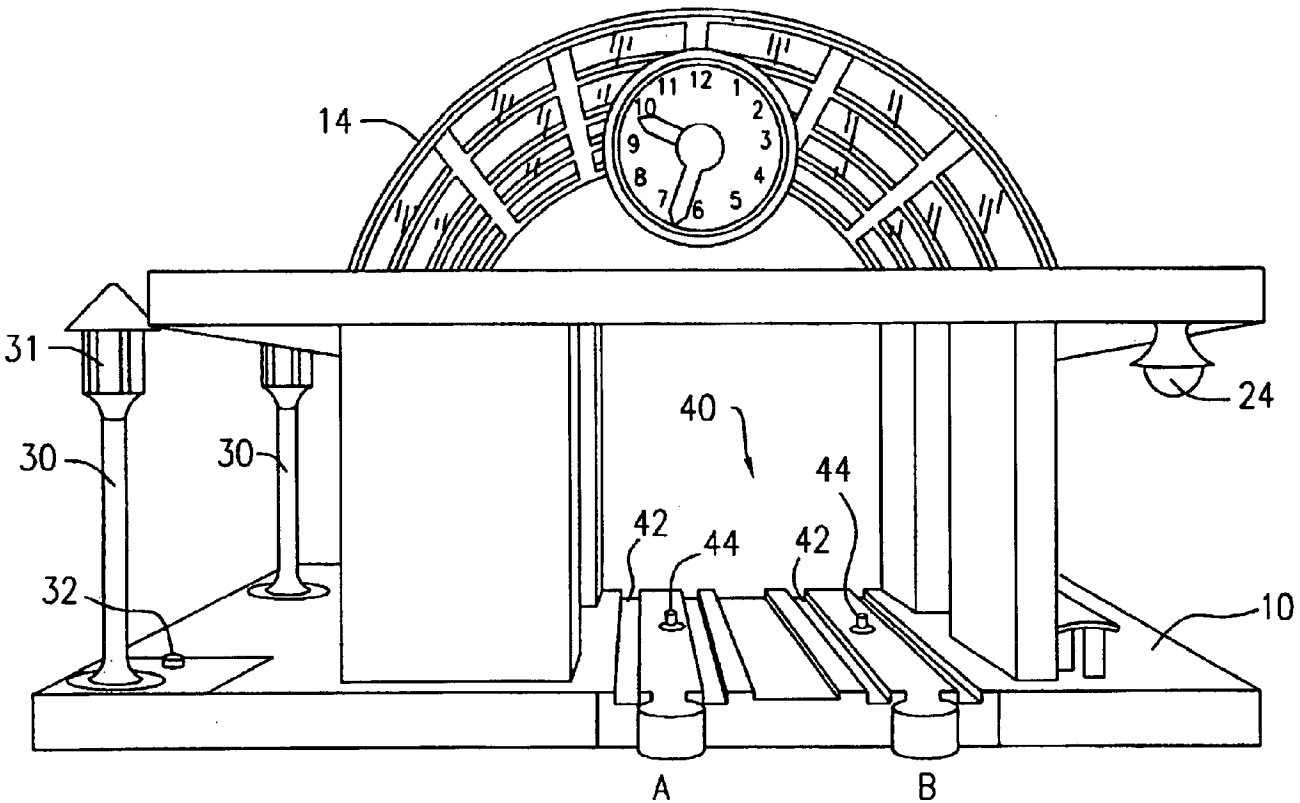
FIG. 2 is a side plan view of a toy train station according to the invention.

One embodiment of a toy train station in accordance with the invention is shown in the figures as station 5. Referring first to FIGS. 1 and 2, station 5 includes a base 10 which may be attached to or included within the circuit of a toy train track. The basic (and largely cosmetic) visible portions of station 5 are front panel 12 and roof 14, which are provided to simulate a train station. Front panel 12 may include several features, such as a ticket window 16, a door 18, and a train schedule 20 which may be hand manipulated for enhanced play value. The various panels of train schedule 20 are rotatable via pins or handles 22 which enable the user to select one of several "destinations" for the schedule. Hanging lamps 24 may be provided as well as lamps 31 atop lamp posts 30, both of which may be powered to light at predetermined times as will be explained below. A manual activation button 32 may be provided for activating lamps 24 or 31 and for activating other functional aspects of station 5.

Referring to FIG. 2, a track area 40 is formed in base 10 for allowing a toy train to pass through the station 5 from one section of track to another section of track on the opposite side of the station. Track area 40 is provided with conventional track attachment means, such as the male and female connectors shown in the FIGS. Channels 42 are formed in track area 40 on the upper surface of base 10 to function as "rails" for the wheels of the toy train, i.e., the wheels of the train fit into and pass along channels 42 in the same way the wheels would for any other section of track.

Disposed through slots 43 in track section 40 are sensors 44. When the train passes over a sensor 44, the sensor causes lights 24 and 31 to turn on or flash, and/or a sound generating device such as a speaker may be activated as well.

Figure 3:
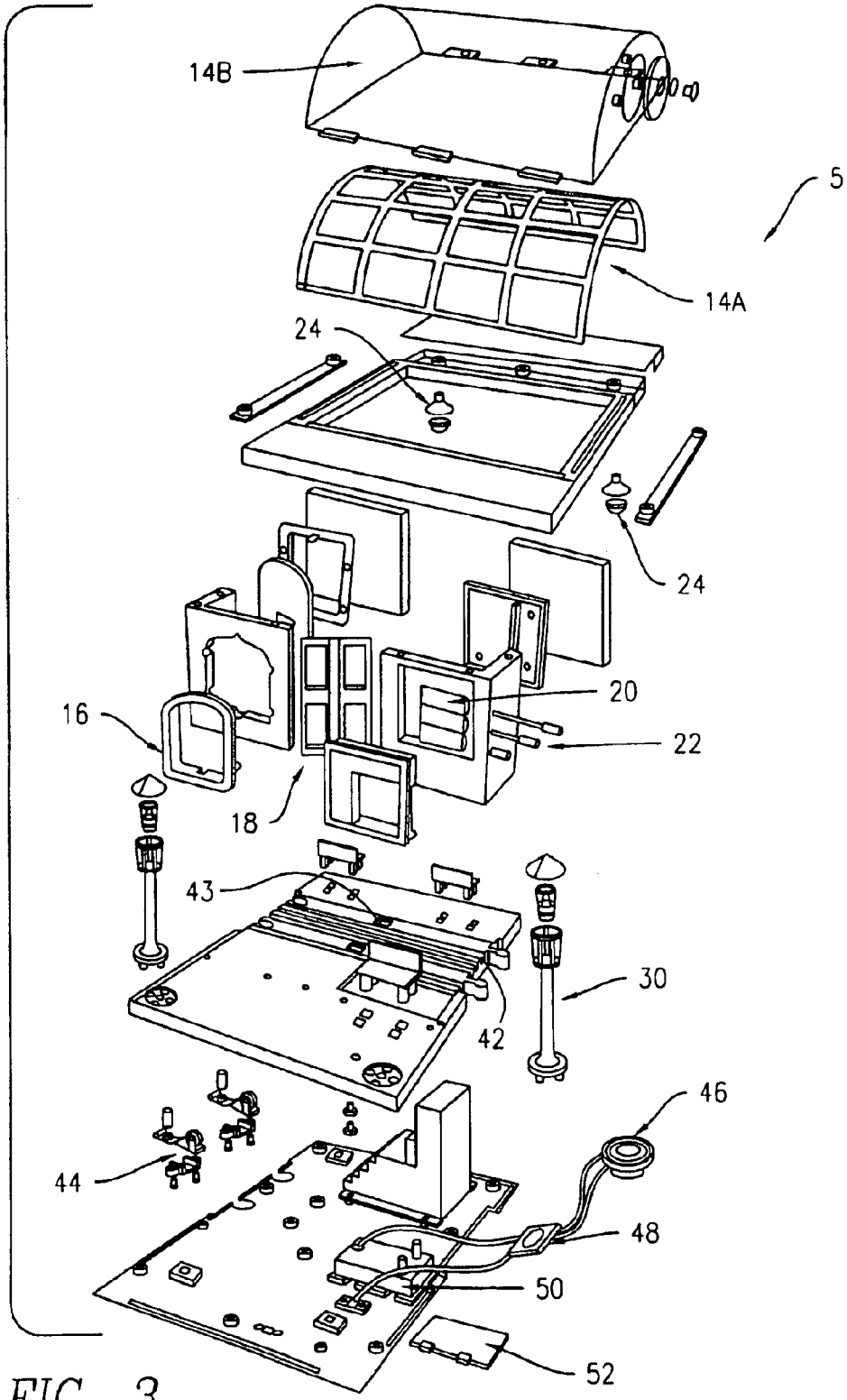
FIG. 3 is an exploded perspective view of a toy train station according to the invention.
Figure 4:
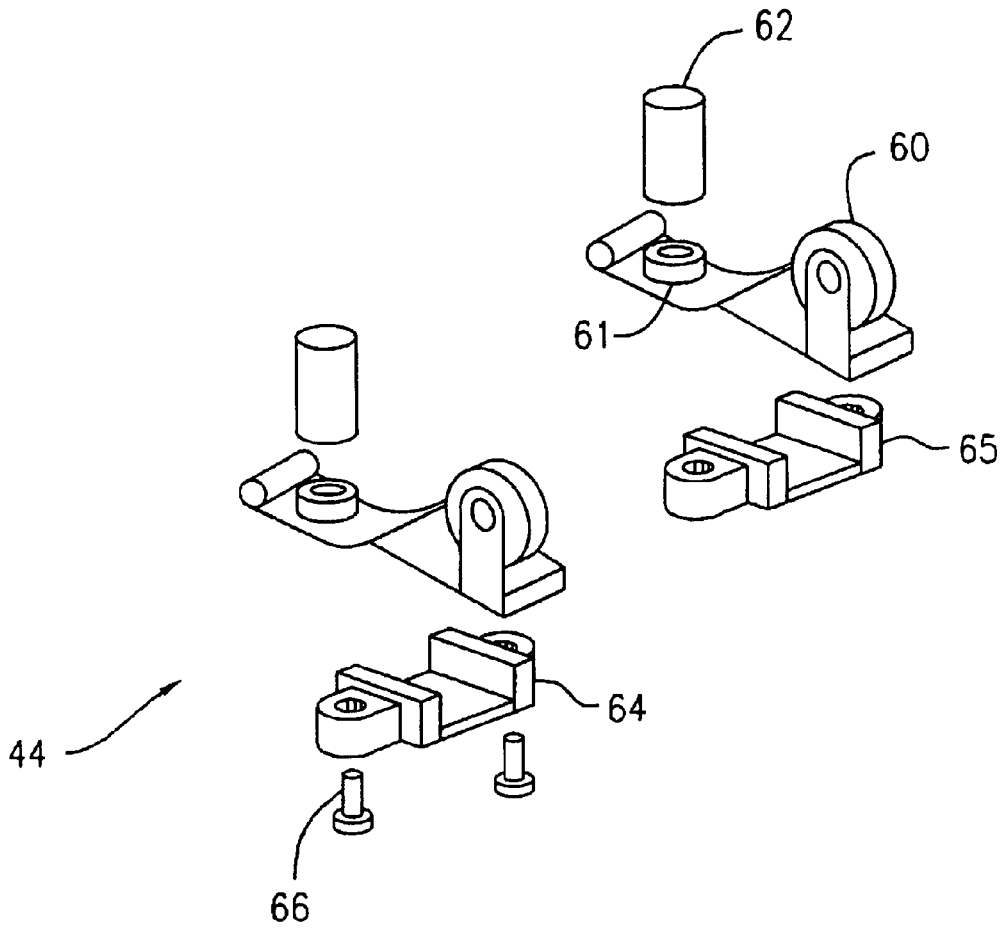
FIG. 4 is an enlarged perspective view of the sensor of FIG. 3.

FIG. 3 is an exploded perspective view of station 5, and FIG. 4 is an enlarged view of the sensors. From FIG. 3 it can be seen that this embodiment of sensors 44 are preferably attached to the underside of track area 40 and may be spring-biased to project through slots 43 in track area 40. Slots 43 and sensors 44 are positioned between adjacent channels 42 so that when a train passes through station 5 along channels 42, the train necessarily is detected by sensors 44. Sensors 44 are preferably connected to an electronic circuit board 48 which is, in turn, connected to the various "entertainment devices" of the station 5 such as lights 24 and 31 and speaker 46. A battery case 50 and a cover 52 therefor are provided so that a battery (not shown) can supply the power for the various entertainment devices of the station 5 without requiring the station to be connected to an AC line. The present invention, in its preferred form, is/or use with inexpensive, track and trains where power to drive the train is not provided by the electric power impressed to the rails. Rather, the inexpensive toy trains are driven by self-contained motors and batteries.

In operation, when a train passes along one of the tracks of track area 40, it passes over sensor 44. The sensor 44 detects the presence of the train and sends a signal to circuit board 48. The algorithms of circuit board 48 cause one or more of the entertainment devices to be activated or to function in a different way than when the train is not present and detected. For example, when a train is detected, the lights 24 and 31 can be activated for a predetermined period of time; alternatively, they can flash instead of beaming continuous light. At the same time (or at any other predetermined time) circuit board 48 can activate speaker 46 to generate predetermined or prerecorded sounds, such as a train clacking noise, a train whistle, music, a simulated train conductor's "All aboard!", or simulated train station announcements.

A number of prerecorded sounds may be available for reproduction whenever sensor 44 detects a train, and the sounds may be played in a predetermined order one at a time each time a train passes through the station 5, or randomly, or however desired. Also, different sounds may be generated depending upon which sensor 44 detects the train. That is, a train detected by sensor 44 of track A (see FIG. 2) may cause a first prerecorded sound (or one or more of a first set of prerecorded sounds) to be reproduced, and a train detected by sensor 44 of track B may cause a second prerecorded sound (or one or more of a second set of prerecorded sounds) to be reproduced.

Figure 5:
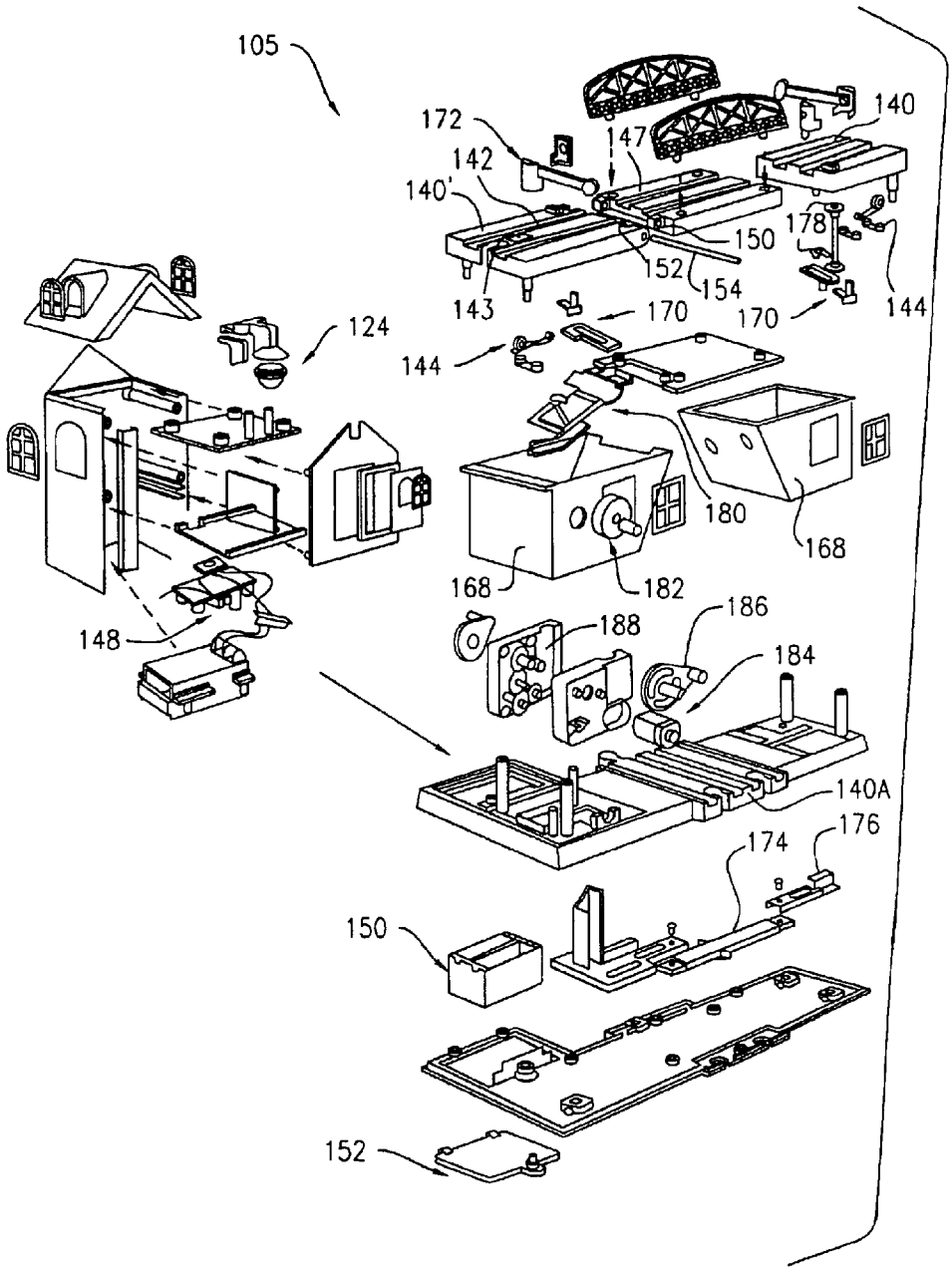
FIG. 5 is an exploded perspective view of a lifting bridge according to the invention.
Figure 6:
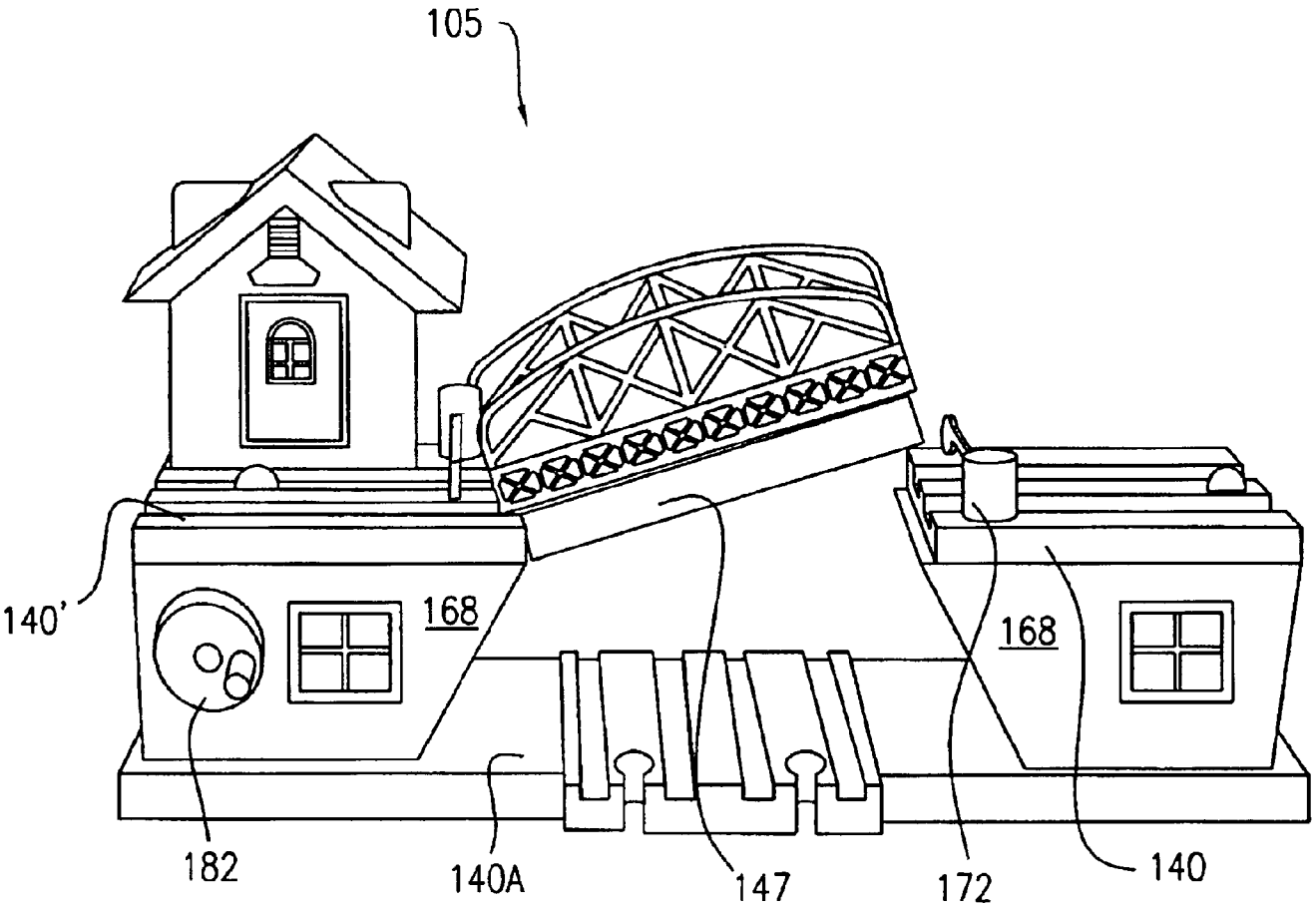
FIG. 6 is a perspective view of the lifting bridge and underpass shown in FIG. 5.

Another embodiment of the invention is shown in FIG. 5 in exploded perspective view as lifting bridge 105. Central bridge section 147 is flanked on both sides by track sections 140 and 140'; both track sections 140, 140' and bridge section 147 include channels 142 to accommodate the wheels of a toy train. Bridge section 147 is integrally connected to track section 140', preferably in a pivotable fashion. Bridge section 147 includes tabs 150 fittable into slots 152 of track section 140' and secured by horizontal pin 154. Track sections 140 and 140' and bridge section 147 are elevated above lower track section 140A because they are supported by bridge bases 168 which house various mechanical components described below. One or both track sections 140, 140' are provided with slots 143 through which sensors 144 are upwardly biased to emerge. Bridge 105 may be powered by batteries sitting in battery case 150 and retained therein by battery case door 152. Circuit board 148 and light 124 are respectively substantially similar to circuit board 48 and connected lights, as described above.

Among the entertainment devices controlled by sensors 144 are traffic signals 172 which are pivotably raisable and lowerable via the actuation of gearing 170. Connecting rod 174 may be provided to control both traffic signals 172 at the same time, i.e., to lower them both when bridge section 147 is raised and to raise them both when bridge section 147 is lowered. In this embodiment, teeth 176 cooperate with gearing 178 to move the traffic signals. Lever 180 raises and lowers bridge section 147 and is actuated either manually by hand crank 182 or automatically via motor 184. Either way, cam 186 cooperates with gearing 188 to cause lever 180 to ascend or descend to carry bridge section 147 therewith.

In operation, when a train passes over a track section upstream of either track section 140 or 140', it trips a sensor 144. A signal is sent to circuit board 148 which controls the operation of, e.g., light 124, traffic signals 172, and most importantly, bridge section 147. Bridge section 147 is lowered so that the train may continue to travel. After the train passes there over or a predetermined period of time, sense 144 of track section 140 or 140' is tripped, and bridge section 147 may be raised again. Alternative track section 140A may be provided with a sensor which causes the bridge section to ascend to allow a train passing underneath free passage.

As mentioned above, the sensors 44 may be of any conventional variety, e.g., a leaf spring, a photosensor, a magnet sensor, etc. One embodiment of sensor 44 is shown enlarged in FIG. 4. A roller 60 is positioned at one end of a cantilever arm 61; the opposite end of arm 61 is fixed to base 10 of station 5, for example, by rivet or bolt 62. Disposed below but not normally contacting arm 61 is a contact 64 which is provided with a notch 65. Contact 64 is secured to base 10 by screws 66 or other fasteners or by adhesive, etc.. Because arm 61 is a leaf spring, it biases roller 60 upwards through slot 43. Alternatively, arm 61 may be stiff and unyielding yet attached not by a rivet or bolt but by a coil spring. In either event, when the train runs over sensor 44, the train contacts roller 60 and pushes it downward against the spring bias, thereby causing arm 61 to move downward into notch 65 of contact 64. When arm 61 abuts contact 64, an electrical circuit is completed, and a signal is sent to the circuit board as described above. After the train has passed by, the sensor re-emerges through slot 43 and out of contact with contact 64.

The advantages of this feature of the invention over the prior art are easily recognized. First, the sensor is built into the track area 40 of train station 5 (and track area 140 of station 105) itself; there is no need to place a separate sensing device on a track section and "hope" that it is properly aligned with the train's travel path to be activated by a passing train but not interfere with the train as it travels thereby. Moreover, sensor 44 is directly connected to the circuit board and does not require that electricity pass through any exposed parts.

The invention is not limited to the above description. For example, the portion of the sensor that projects from the track area of the station is shown as a roller. A roller is preferred because the train passes over the sensor and remains in contact with the sensor until the train has completely passed by. A roller causes rolling friction between the sensor and the train; rolling friction is typically of much less magnitude than sliding friction. However, a simple projection (e.g., a ramped projection) can be provided as an alternative to the roller. Also, the above description includes a circuit board between the sensor and the entertainment devices of the station. In the alternative, the sensor could be connected directly to the entertainment devices, so that when the circuit is completed by the depression of the leaf spring (or by the operation of any of the other possible sensor embodiments), the entertainment devices are simply activated as long as the circuit is complete (i.e., as long the train is pushing the sensor downwards). Time delays may be incorporated into the circuitry. Further, the entertainment devices are not limited to lights and sounds; other mechanical devices may be provided, for example, the doors of the train station may be made to open or revolve, the train schedule may be made to change, and the like.

The invention is not limited to the above description but rather is defined by the claims appearing hereinbelow. Modifications to the above description that include that which is known in the art are well within the scope of the contemplated invention.

What is claimed is:

1. A toy train accessory for use with a toy train riding on a toy train track, comprising:

at least one track section disposed across said accessory and connectable to a toy train track;

a slot formed in said track section;

a sensor disposed in said slot, wherein said sensor includes an upwardly biased spring, wherein when a train passes over said sensor, the train depresses said spring which causes said sensor to send an activation signal to at least one entertainment device;

said at least one entertainment device being connectable to said sensor, wherein when a toy train passes over said sensor on said,track, said entertainment device is activated.

2. A toy train accessory according to claim 1, wherein said entertainment device comprises at least one of a light and a sound generator.

3. A toy train accessory according to claim 2, wherein said sound generator plays prerecorded sounds when activated.

4. A toy train accessory according to claim 3, wherein said prerecorded sounds include at least one of a train clacking noise, a train whistle, music, and simulated train station announcements.

5. A toy train accessory according to claim 3, wherein said sound generator will select a different of said prerecorded sounds each time said sound generator is activated.

6. A toy train accessory according to claim 1, further comprising a circuit board connected between said sensor and said entertainment device for controlling the activity of said entertainment device.

7. A toy train accessory according to claim 6, wherein said entertainment device comprises a sound generator that plays prerecorded sounds when activated by said circuit board.

8. A toy train accessory according to claim 7, wherein said prerecorded sounds include at least one of a train clacking noise, a train whistle, music, and simulated train station announcements.

9. A toy train accessory according to claim 7, wherein said circuit board will select a different of said prerecorded sounds each time said sound generator is activated by said circuit board.

10. A toy train accessory according to claim 1, further comprising a roller rotatably disposed on a free end of said spring, said roller projecting through said slot and coming into rolling contact with a toy train passing over said slot.

11. A toy train accessory according to claim 1, wherein said spring is a leaf spring.

12. A toy train accessory according to claim 1, wherein said sensor is a photosensor, wherein when the train passes over said sensor, said sensor optically detects the train passing thereover which causes said sensor to send an activation signal to said entertainment device.

13. A toy train accessory according to claim 1, further comprising a plurality of said tracks, at least two of said plurality of tracks being respectively provided with one of a plurality of said sensors.

14. A toy train accessory according to claim 13, wherein each of said sensors is connected to said entertainment device.

15. A toy train accessory according to claim 13, further comprising a circuit board connected between said sensors and said entertainment device for controlling the activity of said entertainment device.

16. A toy train accessory according to claim 15, wherein said circuit board causes said entertainment device to function differently depending upon which of said sensors detects the train.

17. A toy train accessory according to claim 16, wherein said entertainment device is a sound generator producing prerecorded sounds, and wherein said circuit board causes said sound generator to produce a different of said prerecorded sounds depending upon which of said sensors detects the train.

18. A toy train accessory according to claim 1, wherein said accessory comprises a toy train station.

19. A toy train accessory according to claim 1, wherein said accessory comprises a toy train bridge and said entertainment device comprises a raisable and lowerable section of said bridge.

20. A toy train accessory according to claim 1, wherein said entertainment device comprises a traffic signal arm.

* * * * *